US007527267B2

(12) United States Patent
Webb et al.

(10) Patent No.: US 7,527,267 B2
(45) Date of Patent: May 5, 2009

(54) CASINO POKER GAME WITH COMMUNITY HAND PLAYER CHOICE (PICK AND WIN POKER)

(75) Inventors: Derek John Webb, Derby (GB); Shenli Ko, Las Vegas, NV (US)

(73) Assignee: Prime Table Games LLC, Las Vegas, NV (US)

( * ) Notice: Subject to any disclaimer, the term of this patent is extended or adjusted under 35 U.S.C. 154(b) by 291 days.

(21) Appl. No.: 11/317,306

(22) Filed: Dec. 27, 2005

(65) Prior Publication Data

US 2007/0145684 A1 Jun. 28, 2007

(51) Int. Cl.
*A63F 1/00* (2006.01)
*A63F 9/20* (2006.01)

(52) U.S. Cl. ..... 273/292; 273/303

(58) Field of Classification Search ..... 273/292
See application file for complete search history.

(56) References Cited

U.S. PATENT DOCUMENTS 5,657,993 A 8/1997 Merlino et al.
5,816,914 A 10/1998 Wichinsky
6,048,267 A 4/2000 Wichinsky
6,129,357 A 10/2000 Wichinsky
6,511,068 B1 * 1/2003 Sklansky et al. ..... 273/237
6,959,928 B2 * 11/2005 Schultz ..... 273/292
2005/0082758 A1 * 4/2005 Sklansky et al. ..... 273/292
2006/0119044 A1 6/2006 Kekempanos et al.

* cited by examiner

*Primary Examiner*—Gene Kim
*Assistant Examiner*—Michael D Dennis
(74) *Attorney, Agent, or Firm*—Nixon & Vanderhye P.C.

(57) ABSTRACT

A house-banked casino card game includes a dealer having a dealer hand and at least one player having a player hand. The dealer exposes a first community hand and a second community hand, and the player selects one of the first and second community hands as part of the player hand prior to additional cards being exposed. After exposing the additional cards, the dealer selects one of the first and second community hands as part of the dealer hand. The game is resolved based on a comparison of the player hand and the dealer hand. In the casino environment, the game may include an initial wager for the player to participate in the game, and a pick wager after the first and second community hands are exposed, which pick wager serves to select the first or second community hand. At least one bonus wager may also be included and is resolved according to a predetermined payout scale based on at least one of the dealer hand and the player hand or other card combinations.

19 Claims, 1 Drawing Sheet

CASINO POKER GAME WITH COMMUNITY HAND PLAYER CHOICE (PICK AND WIN POKER)

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to a casino poker game and, more particularly, to a casino poker game utilizing community cards wherein a player chooses between different community card hands.

Casino operators are continually searching for ways to make casino table games more attractive and player friendly. New poker derivatives such as Caribbean Stud, Let It Ride, Pai Gow Poker, and Three Card Poker have made a significant contribution. To facilitate the success of a house-banked casino poker variant game, it is important that the casino advantage is reasonable, that the game is relatively easy to understand for both players and dealers, and that there is at least a player perception of a reasonable chance for a player premium hand to defeat the dealer in a competition mode or win an increased payout in a proposition mode or both.

With respect to types of poker, conventional established terms are draw and stud. These terms have become out-of-date as community card games have been established. Community card games such as Hold 'Em and Omaha could be regarded as combining aspects of both draw and stud. In typical community card games, players are dealt player cards and one or more community cards are shared by all the players. The players can then use the community cards together with the player cards to achieve a poker ranking.

BRIEF SUMMARY OF THE INVENTION

The present invention is a house-banked casino poker game where players are provided a choice between multiple community hands. After making an initial wager, the players receive one or more cards, and subsequently a pair of community hands are dealt by the dealer. The player then places a pick wager, which serves to designate the player's community hand choice. One or more additional cards are dealt, and the player forms a poker hand with the original player card(s), the selected community hand, and the additional card(s) and compares the player hand poker rank with a poker rank of the dealer hand. A house advantage is derived in providing the dealer the ability to choose between the community hands after dealing the final card(s).

The game may also include at least one bonus wager that provides an opportunity for higher payouts for premium hands. The bonus wager is preferably resolved according to a predetermined payout scale based on either the dealer hand, the player hand or both. Other variations for the bonus payout may also include the nonselected community hand or other combinations of cards in play.

By permitting players to choose between community hands, players have a perception that premium hands are more easily attained. Moreover, since the game is based on basic poker concepts, the game is easy to understand for both players and dealers. Additionally, the use of a bonus wager provides players an opportunity for a high payout.

In an exemplary embodiment of the invention, a house-banked casino card game is played with a dealer and at least one player. To play the game, the player places an initial wager, and the dealer deals at least one card to the player and at least one card to the dealer. The dealer exposes a first community hand including at least a first community card and a second community hand including at least a second community card, and the player places a pick wager to select one of the first community hand and the second community hand. The dealer exposes a third community hand including at least a third community card. A player hand consists of (1) the at least one card dealt to the player, (2) the selected one of the first community hand and the second community hand, and (3) the third community hand. A dealer hand consists of (1) the at least one card dealt to the dealer, (2) either of the first community hand and the second community hand selected by the dealer after exposing the third community hand, and (3) the third community hand. The initial wager and the pick wager are resolved by comparing a rank of the player hand, such as a poker rank of the player hand, with a rank of the dealer hand, such as a poker rank of the dealer hand.

Prior to dealing at least one card to the player and to the dealer, the method may additionally include the player placing at least one bonus wager, which is resolved according to a predetermined payout scale based on at least one of the dealer hand and the player hand. In one arrangement, the at least one bonus wager is resolved based on the one of the dealer hand and the player hand having a higher poker rank. The at least one bonus wager may be resolved based on a composite hand including cards from both the dealer hand and the player hand. Alternatively, the at least one bonus wager may be resolved based on (1) the at least one card dealt to the player, (2) either of the first community hand and the second community hand, and (3) the third community hand. Still further, the at least one bonus wager may be resolved based on a composite hand including cards from the first, second and third community hands. In one playing mode, the player places multiple bonus wagers.

In resolving the wagers, preferably, a payout of at least 1 to 1 on the initial wager and the pick wager is paid if the player hand poker rank is higher than the dealer hand poker rank.

In one operating mode, one card is dealt to the player and one card is dealt to the dealer, wherein the first community hand consists of one card, the second community hand consists of one card, and the third community hand consists of one card such that the player hand and the dealer hand each consists of three cards. In an alternative operating mode, two cards are dealt to the player and the dealer, wherein the first community hand consists of two cards, the second community hand consists of two cards, and the third community hand consists of one card such that the player hand and the dealer hand each consists of five cards. In this mode, the player and dealer hand ranks may be determined based on a best four card hand out of the five cards in their respective hands. In still another operating mode, two cards are dealt to the player and the dealer, wherein the first community hand consists of three cards, the second community hand consists of three cards, and the third community hand consists of two cards such that the player hand and the dealer hand each consists of seven cards. In this context, the player hand poker rank is determined based on five card combinations from the seven cards in the player hand, and the dealer hand poker rank is determined based on five card combinations from the seven cards in the dealer hand. The poker ranks in this operating mode may alternatively be determined based on seven card combinations from the seven cards in the respective hands.

In another exemplary embodiment of the invention, a method of playing a house-banked casino card game with a dealer and at least one player includes the steps of (a) the player placing an initial wager; (b) exposing a first community hand and a second community hand; (c) the player selecting one of the first community hand and the second community hand; (d) the dealer exposing a third community hand, wherein a player hand comprises (1) the selected one of the first community hand and the second community hand, and (2) the third community hand, and wherein a dealer hand comprises (1) either of the first community hand and the second community hand selected by the dealer after exposing the third community hand, and (2) the third community hand; and (e) resolving the initial wager by comparing a poker rank of the player hand with a poker rank of the dealer hand.

In still another exemplary embodiment of the invention, in a method of playing a house-banked casino card game with a dealer having a dealer hand and at least one player having a player hand, the dealer exposes a first community hand and a second community hand, the player selects one of the first and second community hands as part of the player hand prior to additional cards being dealt, the dealer exposes the additional cards, the dealer selects one of the first and second community hands as part of the dealer hand after the additional cards have been exposed, and the game is resolved based on a comparison of the player hand and the dealer hand.

In yet another exemplary embodiment of the invention, a computer program is embodied in a computer readable medium and effects a computer to carry out the method of playing a casino card according to the invention.

BRIEF DESCRIPTION OF THE DRAWINGS

These and other aspects and advantages of the present invention will be described in detail with reference to the accompanying drawing, in which.

DETAILED DESCRIPTION OF THE INVENTION

Figure 1:
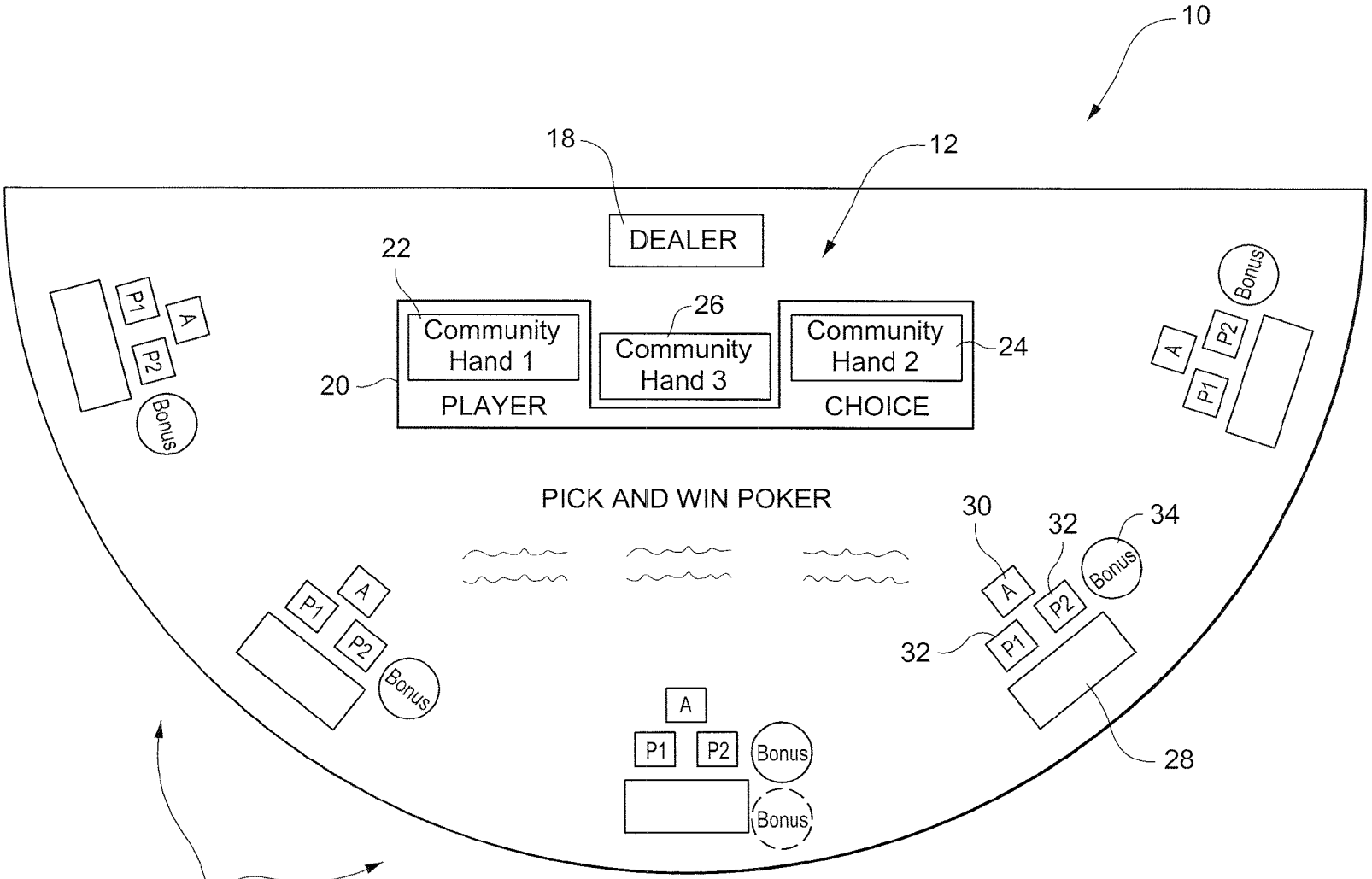
FIG. 1 is a plan view of an exemplary table layout according to the present invention.

In the following detailed description, the method and apparatus according to the present invention will be described in conjunction with its application to a casino environment, thus incorporating wagers, payouts etc. Those of ordinary skill in the art will readily comprehend alternative applications of the present invention outside a casino environment, and the invention is not necessarily meant to be limited to the described application. For example, the game may be embodied in a video game that is played for entertainment purposes against a computer or the like. Alternatively, players may play the game without wagers in a head-to-head format with one player acting as a dealer, and the other player simply keeping track of wins and losses.

FIG. 1 shows a game table including a playing area 10 having a dealer area 12, a player area 14 and promotional markings and game rules 16. The dealer area 12 includes a dealer card box 18 for dealer cards along with a player choice area 20 for a first community hand 22 and a second community hand 24. An area for a third community hand 26 is also a part of the dealer area 12 and is outside of the player choice area 20.

Each player area 14 includes a player card box 28 for placement of player cards along with wager areas 30, 32, 34. As discussed in more detail below, an ante wager area 30 is provided for a compulsory wager to participate in the game. Pick wager areas 32 enable the player during a game to select between the first community hand 22 and the second community hand 24 to form part of the player hand. A bonus wager area 34 may also be included for a bonus proposition wager according to a predetermined payout scale based on one or both of the dealer hand and the player hand. The game may include multiple bonus wager options, and an exemplary second bonus wager area 36 is shown in dashed line in FIG. 1.

In a preferred playing mode, game play proceeds as follows. Initially, one or more players places an ante wager at wager area 30. If the game includes a bonus feature, a bonus wager at area 34 and/or area 36 is also placed. After the initial wager is placed, the dealer deals at least one card to the player and at least one card to the dealer. In this preferred operating mode, each player and the dealer receive one card. Subsequently, the dealer deals (or exposes if the cards have already been 'dealt' face down) a first community hand at area 22 and a second community hand at area 24. In this operating mode, each community hand includes one card. The player then must place a pick wager at one of the pick wager areas 32 to select either the first community hand 22 or the second community hand 24. That is, the player places a second wager, preferably equal to the ante wager 30, over pick wager P1 to select the first community hand or over pick wager P2 to select the second community hand. The dealer then deals (or exposes) a third community hand at card area 26, which in the preferred operating mode is also one card. In one alternative playing mode, the player is provided an opportunity to fold prior to placing the pick wager.

The player hand is thus formed with (1) the at least one card dealt to the player initially, (2) the selected one of the first community hand and the second community hand, and (3) the third community hand. In the preferred playing mode, the player hand thus consists of three cards. The dealer hand is formed of (1) the at least one card initially dealt to the dealer, (2) either of the first community hand and the second community hand, which is selected by the dealer after dealing the third community hand, and (3) the third community hand. There is thus an advantage to the dealer as the dealer does not select between the first community hand and the second community hand until after dealing the third community hand, thus providing a house advantage for casino viability. The initial wager 30 and the pick wager 32 are subsequently resolved by comparing a poker rank of the player hand with a poker rank of the dealer hand, where winning wagers are preferably paid at least 1 to 1.

The bonus wager 34 also forms part of the preferred operating mode. At the conclusion of game play, the bonus wager is resolved according to a predetermined payout scale based on at least one of the dealer hand and the player hand or based on the three community hands, or combinations thereof. As noted, the game may also include multiple bonus wagers. There are many possible variations for determining a bonus wager hand, and the invention is not meant to be limited to a particular card combination. For example, the bonus wager may be resolved on a predetermined payout scale based on the one of the dealer hand and the player hand having a higher poker rank. Alternatively, the bonus wager may be resolved based on a composite hand including cards from both the dealer hand and the player hand. In still another alternative, the bonus wager is resolved based on the player hand, the dealer hand or either hand plus either or both of the first and second community hands or based on the three community hands. These variations may also be included as multiple bonus wager possibilities. Hand rankings other than poker rankings may also be used.

In an alternative operating mode, game play is generally similar to the playing mode described above except that the dealer initially deals two cards to each player and the dealer, and each of the first and second community hands 22, 24 includes two cards. Thus, the player and dealer hands consist of five cards being the initially dealt two cards, the two cards of the selected community hand, and the one card of the third community hand.

In still another playing mode, each player and the dealer receive two cards initially, and the first and second community hands consist of three cards each. The third community hand consists of two cards such that five community cards are available to the players and dealer in addition to the two cards initially dealt. In this playing mode, with two cards for each player and five community cards, game play resembles Texas Hold 'Em.

In each of the playing modes described above, the dealer hand may alternatively consist of dedicated cards dealt only to form the dealer hand, or the dealer hand may consist of dedicated cards plus the third community hand or other combinations. In the preferred playing mode, the dealer hand would thus be formed of three separate cards. In order to ensure a house advantage, under this scenario, the players would be required to place the bonus wager. In a related version, the dealer is provided with dedicated cards, and the players are provided a second choice between a third and fourth community hand. This version would also require the players to place the bonus wager.

In yet another playing mode, the dealer hand consists only of the cards in the first, second and third community hands. In order to ensure a house advantage, the players would be required to place the bonus wager and/or ties would go to the house.

In still another playing mode, the player may be given an option to make a third bet before seeing the third community hand. Also, for five or more card versions, part of the dealer hand (one of the two cards) could be exposed prior to the player making the third bet.

The game is also applicable to non-poker games. For example, in a Blackjack version, after the players place an initial wager, the dealer deals two community cards, and the players choose between the community cards by placing a pick wager or by moving their initial wager to a location designating their choice. After dealing dealer cards and a single card to each player (forming a player hand as the selected community card and the dealt single card), play resumes as in conventional Blackjack.

Other variations and playing modes may also be suitable in the context of the invention, particularly by varying the bet structure or cards delivered per bet, etc., and the invention is not necessarily meant to be limited to the described exemplary playing modes.

As would be apparent to those skilled in the relevant art, the embodiments described above can be embodied in a wide variety of forms and media including, but not limited to, single player slot video machines, multi-player slot video machines, electronic games and devices, lottery terminals, scratch-card formats, software as well as in-flight, home and Internet entertainment. In addition, the described embodiments can also be readily implemented as a computer program product (e.g., floppy disks, compact disks, etc.) comprising a computer readable medium having control logic reported therein to implement the features of the invention as described in relation to the other preferred embodiments. The control logic can be loaded into the memory of a computer and executed by a central processing unit (CPU) to perform the operations described herein.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a house-banked casino card game with a dealer and at least one player using at least one physical deck of playing cards, the method comprising:

(a) the player placing an initial wager;

(b) the dealer dealing from the at least one physical deck of cards at least one card to the player and at least one card to the dealer;

(c) the dealer exposing face up from the at least one physical deck of cards a first community hand including at least a first community card and a second community hand including at least a second community card;

(d) the player placing a pick wager to select one of the first community hand and the second community hand prior to the dealer exposing face up a third community hand;

(e) the dealer exposing face up from the at least one physical deck of cards the third community hand including at least a third community card, wherein a player hand consists of (1) the at least one card dealt to the player in step (b), (2) the selected one of the first community hand and the second community hand, and (3) the third community hand, and wherein a dealer hand consists of (1) the at least one card dealt to the dealer in step (b), (2) either of the first community hand and the second community hand selected by the dealer after exposing face up the third community hand, and (3) the third community hand; and (f) resolving the initial wager and the pick wager by comparing a rank of the player hand with a rank of the dealer hand.

2. A method according to claim 1, further comprising, prior to step (b), the player placing at least one bonus wager, and after step (e), resolving the at least one bonus wager according to a predetermined payout scale based on at least one of the dealer hand and the player hand.

3. A method according to claim 2, wherein the at least one bonus wager is resolved based on the one of the dealer hand and the player hand having a higher poker rank.

4. A method according to claim 2, wherein the at least one bonus wager is resolved based on a composite hand including cards from both the dealer hand and the player hand.

5. A method according to claim 2, wherein the at least one bonus wager is resolved based on (1) the at least one card dealt to the player in step (b), (2) either of the first community hand and the second community hand, and (3) the third community hand.

6. A method according to claim 2, wherein the at least one bonus wager is resolved based on a composite hand including cards from the first, second and third community hands.

7. A method according to claim 2, wherein the player places multiple bonus wagers.

8. A method according to claim 1, wherein step (f) is practiced by paying a payout of at least 1 to 1 on the initial wager and the pick wager if the player hand poker rank is higher than the dealer hand poker rank.

9. A method according to claim 1, wherein step (b) is practiced by dealing one card to the player and one card to the dealer, and wherein the first community hand consists of one card, the second community hand consists of one card, and the third community hand consists of one card such that the player hand and the dealer hand each consists of three cards.

10. A method according to claim 1, wherein step (b) is practiced by dealing two cards to the player and two cards to the dealer, and wherein the first community hand consists of two cards, the second community hand consists of two cards, and the third community hand consists of one card such that the player hand and the dealer hand each consists of five cards.

11. A method according to claim 10, wherein the player hand rank and the dealer hand rank are determined based on a best four card hand formed from the five cards respectively in the player hand and the dealer hand.

12. A method according to claim 1, wherein step (b) is practiced by dealing two cards to the player and two cards to the dealer, wherein the first community hand consists of three cards, the second community hand consists of three cards, and the third community hand consists of two cards such that the player hand and the dealer hand each consists of seven cards.

13. A method according to claim 12, wherein the player hand poker rank is determined based on five card combinations from the seven cards in the player hand, and wherein the dealer hand poker rank is determined based on five card combinations from the seven cards in the dealer hand.

14. A method according to claim 12, wherein the player hand poker rank is determined based on seven card combinations from the seven cards in the player hand, and wherein the dealer hand poker rank is determined based on seven card combinations from the seven cards in the dealer hand.

15. A method according to claim 1, wherein step (f) is practiced by resolving the initial wager and the pick wager by comparing a poker rank of the player hand with a poker rank of the dealer hand.

16. A method of playing a house-banked casino card game with a dealer and at least one player using at least one physical deck of playing cards, the method comprising:

(a) the player placing an initial wager;

(b) exposing face up from the at least one physical deck cards a first community hand and a second community hand;

(c) the player selecting one of the first community hand and the second community hand prior to the dealer exposing face up from the at least one physical deck of cards a third community hand;

(d) the dealer exposing face up from the at least one physical deck of cards the third community hand, wherein a player hand comprises (1) the selected one of the first community hand and the second community hand, and (2) the third community hand, and wherein a dealer hand comprises (1) either of the first community hand and the second community hand selected by the dealer after exposing the third community hand, and (2) the third community hand; and (e) resolving the initial wager by comparing a rank of the player hand with a rank of the dealer hand.

17. A method according to claim 16, further comprising, prior to step (b), dealing at least one card to the player and at least one card to the dealer, wherein the player hand and the dealer hand further comprise the at least one card dealt prior to step (b).

18. A method according to claim 16, further comprising, prior to step (b), the player placing a bonus wager, and after step (d), resolving the bonus wager according to a predetermined payout scale based on at least one of the dealer hand and the player hand.

19. A computer program embodied in a computer readable medium, the computer program effecting a computer to carry out a method of playing a casino card game with a dealer and at least one player, the method comprising:

(a) the player placing an initial wager;

(b) the dealer dealing at least one card to the player and at least one card to the dealer;

(c) the dealer exposing a first community hand including at least a first community card and a second community hand including at least a second community card;

(d) the player placing a pick wager to select one of the first community hand and the second community hand prior to the dealer exposing face up a third community hand;

(e) the dealer exposing a third community hand including at least a third community card, wherein a player hand consists of (1) the at least one card dealt to the player in step (b), (2) the selected one of the first community hand and the second community hand, and (3) the third community hand, and wherein a dealer hand consists of (1) the at least one card dealt to the dealer in step (b), (2) either of the first community hand and the second community hand selected by the dealer after exposing the third community hand, and (3) the third community hand; and (f) resolving the initial wager and the pick wager by comparing a rank of the player hand with a rank of the dealer hand.

* * * * *